US006378453B1

(12) United States Patent
Conway

(10) Patent No.: US 6,378,453 B1
(45) Date of Patent: Apr. 30, 2002

(54) FOLDABLE FLEXIBLE VEHICLE LOCATOR

(76) Inventor: Eugene Conway, 20 Deepdale Dr., Huntington Station, NY (US) 11746

( * ) Notice: Subject to any disclaimer, the term of this patent is extended or adjusted under 35 U.S.C. 154(b) by 0 days.

(21) Appl. No.: 09/525,743

(22) Filed: Mar. 14, 2000

(51) Int. Cl.[7] ..... G09F 17/00

(52) U.S. Cl. ..... 116/28 R; 116/209; 116/173; 40/591

(58) Field of Search ..... 116/28 R, 209, 116/30, 42, 173; 40/591, 592, 606, 608, 607, 610; 248/121, 511, 519, 623; 403/229

(56) References Cited

U.S. PATENT DOCUMENTS 1,859,599 A * 5/1932 Quinn ..... 116/173
2,976,000 A * 3/1961 Gunderson ..... 116/173
3,169,739 A * 2/1965 Yocobian ..... 116/173
3,241,516 A * 3/1966 Hopkins ..... 116/173
3,279,133 A * 10/1966 Korte ..... 116/209
4,574,726 A * 3/1986 Sullivan ..... 116/28 R
4,590,883 A * 5/1986 Steed et al. ..... 116/173
4,711,391 A * 12/1987 Roge et al. ..... 232/35
4,817,927 A * 4/1989 Martin ..... 16/299
5,060,995 A * 10/1991 Goldstein et al. ..... 160/178.1 R
5,186,119 A * 2/1993 Hlavin ..... 116/209
D359,924 S * 7/1995 Grumbeck ..... D10/110
D376,179 S * 12/1996 Cohen ..... D20/41

* cited by examiner

*Primary Examiner*—Andrew H. Hirshfeld
(74) *Attorney, Agent, or Firm*—Alfred M. Walker

(57) ABSTRACT

A vehicle locator device including an easily visible flag with recognizable indicia thereon, such as vendor advertising logs, wherein the flag is supported above the top height of the vehicle by an elongated compression spring pole or mast at a distal end thereof. Because of the compression spring, the vehicle locator is foldable about itself into a loop, so that it can be reduced in size and fit within the glove compartment of a vehicle for storage when not in use.

6 Claims, 4 Drawing Sheets

FOLDABLE FLEXIBLE VEHICLE LOCATOR

FIELD OF THE INVENTION

The present invention relates to visually perceptible flags, such as vehicle locator flags.

BACKGROUND OF THE INVENTION

Various attempts have been made to provide portable vehicle locator flags to assist motorists in locating vehicles in large parking lots, such as at sports arenas, shopping mall parking lots and makeshift parking fields at outdoor musical concerts.

Usually a flag or pennant is attached to an upwardly extending mast or pole, which is removably attached to the vehicles, such as a clip over an upper edge of a vehicle window, or by magnets, or other attachment devices which temporarily support the flag and mast above the top of the vehicle. Among these patents include Design Pat. No. D.376,179 of Cohen and U.S. Pat. No. 3,715,821 of Hawes for vehicle locator flags upon rigid flagpoles.

However, the masts in Cohen '179 and Hawes '821 are rigid and cannot be reduced in size to fit in vehicle glove compartments.

In some cases, to resist breaking in windy weather conditions, the pole or mast is flexible, such as a pole or mast made of a flexible plastic, for example, polyethylene or otherwise, as noted in U.S. Pat. No. 5,233,938 of Lalo. However, polyethylene plastic can only be bent slightly, and certainly not folded 180 degrees or more around into a loop.

Furthermore, achieving a prominent height is important so that the flag can be seen from far away. To be so seen, the flag should be at least the height of tall vehicles, such as sport utility vehicles or minivans, especially if the users vehicle to be located is a low-rise sports car or compact sedan.

However, the taller the height of the flag or mast, the more inconvenient it is to store the flag and mast or pole when not in use. While most vehicle locator flags will fit within the trunk of a motor vehicles, some vehicles, such as minivans, don't have rear trunks, and for the majority of vehicles with rear trunks, it is convoluted and inconvenient for the driver to have to go around the vehicle to its rear trunk lid, insert a key or initiate a wireless transmission remote opener and then bring the flag and pole or mast to the rear of the vehicle, for insertion within the rear trunk, then manually close the trunk lid and return to the vehicle driver's seat.

Many drivers resist the extra effort of storing long item similar in size and shape to vehicle locator flags, i.e. ice scrapers or brushes, within the rear trunk. In that case, the items such as vehicle locator flags are stored on the floor of the vehicle, or under seats, which clutters the vehicle interior or interferes with passenger comfort.

To solve this problem, it has been shown that flag masts or poles can be reduced in length, by the use of telescoping masts or poles, which can be stored compactly in the glove compartment. Vehicle locator flags with telescoping masts are described in U.S. Pat. No. 4,574,726 of Sullivan and D359,924 of Grumbeck.

However making a telescoping mast is complicated and expensive, and the sliding parts can be sometimes broken.

Moreover, the larger number of telescoping parts needed to reduce the length of the mast may make the mast too flimsy and too flexible, so that the mast does not stay erect for viewing from far away.

If the number of telescoping parts is reduced, then the resultant reduced length of the mast may be too large to fit within a conventional glove compartment of an automobile.

Other prior art patents include U.S. Pat. No. 3,738,309 of Nicholl for a collapsible warning sign, U.S. Pat. No. 3,935,633 of Fritzinger for a vandal proof street sign pole, U.S. Pat. No. 4,163,426 of O'Neill for a highway safety flag and lighted display, D306,876 for a spring clip, U.S. Pat. No. 5,311,688 of Aeschbacher for a display sign for locating underground pipes, including a ratchet with a compression spring, U.S. Pat. No. 5,425,444 of Chapman for a merchandise display with supports separated by a compression spring, U.S. Pat. No. 5,771,836 of Crouse for a water ski warning display, D326,432 of McNulty for a pivotable automobile pennant, U.S. Pat. No. 5,590,621 of Sectish for a vehicle procession safety flag, U.S. Pat. No. 4,827,646 of Miller for a vehicle sign display that is raised and lowered by pivoting hinges, D314,911 of Spica for a clip, U.S. Pat. No. 5,226,792 of Darago for an automobile window distress flag, D322,413 of Castillo for a rigid vehicle locator sign and flag, D330,730 of Watanabe for a sign pole, U.S. Pat. No. 4,751,494 of Cromwell for an emergency flasher for a motorist, U.S. Pat. No. 4,144,833 of Newman for a emergency distress signal and D336,056 of Valdez for a parking location marker. U.S. Pat. No. D363,446 of MacDonald shows a vehicle locator flag with a sleeve insertable over an antenna. U.S. Pat. No. 4,178, of Berns describes a window engaging vehicle emergency signal sign. Other related patents include U.S. Pat. No. 4,471,873 of Thomas, U.S. Pat. No. 4,542,757 of Phillips, U.S. Pat. No. 4,178,874 of Berns, U.S. Pat. No. 4,833,443 of Siew, U.S. Pat. No. 4,964,360 of Henry, U.S. Pat. No. 4,976,410 of Tomaiuolo, U.S. Pat. No. 5,016,372 of Gold, U.S. Pat. No. 5,089,803 of Bohn, U.S. Pat. No. 5,140,933 of Nishina et al., U.S. Pat. No. 5,320,061 of Laughlin et al., U.S. Pat. No. 5,388,546 of Lombard, U.S. Pat. No. D376,179 of Cohen and U.S. Pat. No. 5,636,588 of Keller et al.

However these patents do not disclose a vehicle locator having a bendable, flexible flag supporting mast made of a compression spring. Compression springs are used with store merchandise display hooks, but not as support masts themselves. For example, rigid hooked masts are disclosed in U.S. Pat. No. 4,475,658 of Roberts, and U.S. Pat. No. 5,222,608 of Eklof, wherein compression springs surround the hooked masts to push the merchandise out towards the hooks ends of the rigid masts. Therefore, these patents do not disclose the use of compression springs as erect, flexible, bendable flag supporting masts.

OBJECTS OF THE INVENTION

Therefore, it is an object of the present invention to provide a vehicle locator flag with flexible yet firm pole or mast which flexes with the wind without breaking, but which is firm enough to stay erect and keep the flag visually perceptible from a viewing distance far away from the vehicle.

It is also an object to provide a flexible flagpole or mast which can be simply folded to a small size so that it can be stored within a vehicle glove compartment and easily unfolded for future use.

It is yet another object to provide a vehicle locator flag, which is sturdy, weather proof and easy to assemble with a minimum of parts.

It is also an object of the present invention to provide easily recognizable indicia on vehicle locator flags, such as vendor advertising logos.

It is still yet another object of the present invention to improve over the disadvantages of the prior art.

SUMMARY OF THE INVENTION

In keeping with these objects and other which may become apparent, the present invention includes a vehicle locator device including an easily visible flag with recognizable indicia thereon, such as vendor advertising logos, wherein the flag is supported above the top height of the vehicle by an elongated pole or mast at a distal end thereof.

The flagpole or mast is made of a flexible but sturdy material, such as a compression spring having an attachment member, with a window edge-engaging member, such as a clip, at a proximal end thereof.

Preferably the compression spring is made of a strong but flexible material, such as 64 point piano wire, consisting essentially of a steel and phosphate metal alloy including the following components indicated by percentage weight of the total composition: about 0.090% copper (Cu), about 0.006% phosphorus (P), about 0.53% manganese(Mn), about 0.16% silicon (Si), about 0.86% carbon (C) and about 0.004% sulfur (S), with the balance being recycled steel. Such a wire is manufactured by Spring Wire, Sweden AB and by Amstek Metal Company of Farmington, Conn.

Before being formed into a coiled compression spring, mast for the present invention, the piano wire is a cylindrical rod having a diameter of 0.0625 inches. It is spun into a twisted, coiled helix forming a longitudinally extending compression spring.

For weather and waterproofing, preferably the compression spring mast is coated with a nickel or tin alloy before being spun into a twisted coiled helix.

The flagpole or mast is preferably 27 inches in height to project the viewable flag above the roof of an adjacent tall vehicle, such as a minivan or sports utility vehicle.

In addition, preferably the flagpole or mast is about ¼ inch in outer diameter (OD) and ⅛th inch in inner diameter (ID).

A small section of between 1 and 2 inches in axial length is wider at the proximal end thereof, to accommodate the insertion of a support post of a window-engaging base clip therein. The support post has a circumferentially extending scored channel recess, to accommodate the lowest, last proximal twist of the compression spring therein.

While the compression spring mast is generally erect during windy conditions, because of its modulus of elasticity, it can be folded about itself several times around into a loop, so that the looped compression spring mast now has a small diameter of about 6–8 inches.

Therefore, the mast can be folded and squeezed into a circular or oval shape, which easily fits within the glove compartment of a car or other vehicle.

The modulus of elasticity (E) of the compression spring is about $30\times10^6$ psi, which is about $207\times10^3$ MPa (mega pascals). It has a minimal tensile strength of 296,000 psi or about 2041 Mpa.

While the attachment means can be a magnet attachable to a metal surface of the vehicle, preferably it is a window edge engaging U-shaped clip, with a support brace. In addition, an auxiliary clip can keep the folded mast in a closed position within the glove compartment.

DESCRIPTION OF THE DRAWINGS

The present invention can best be understood in convention with the accompanying drawings in which.

DETAILED DESCRIPTION OF THE DRAWINGS

Figure 1:
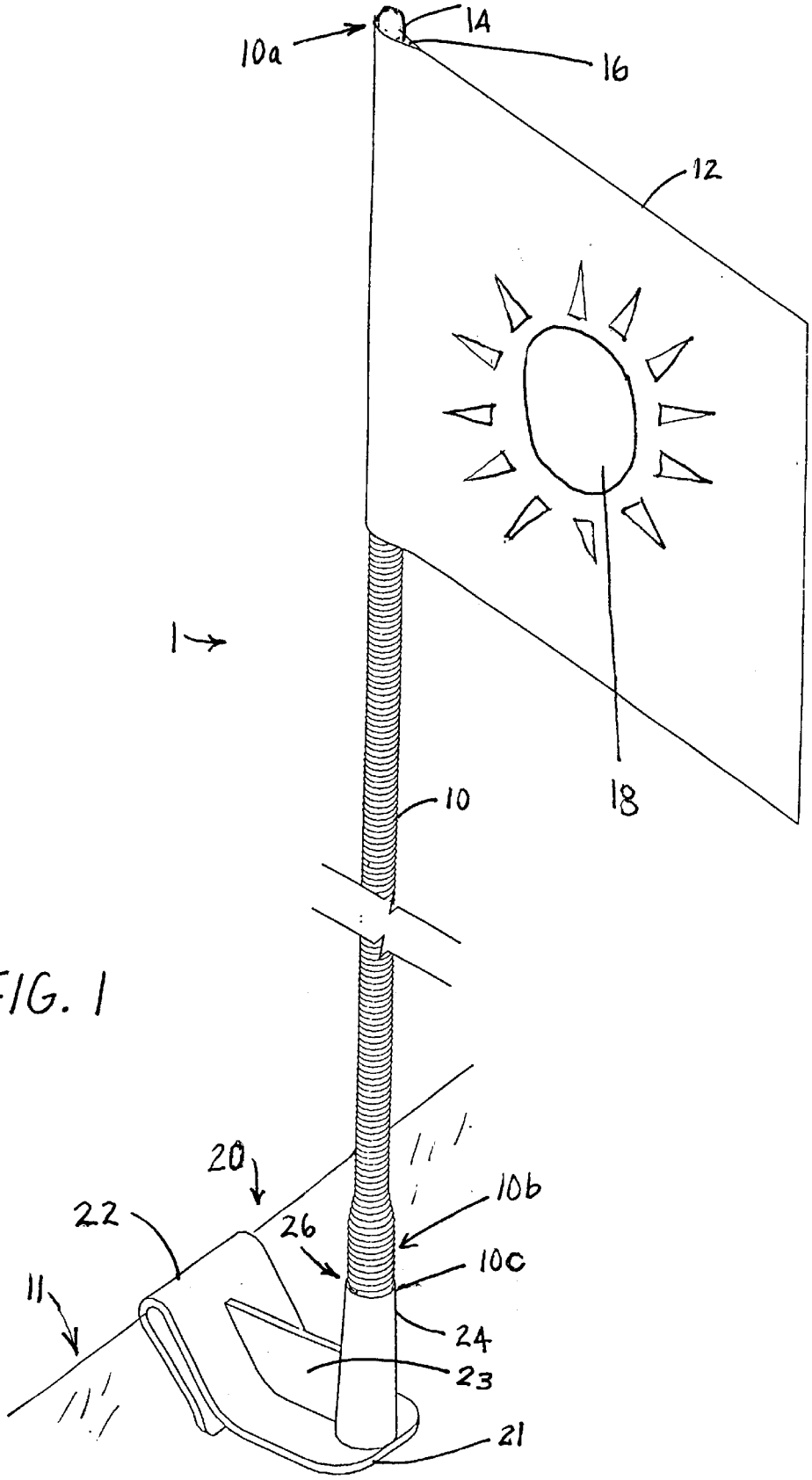
FIG. 1 is an isometric view of the foldable, flexible vehicle locator of the present invention installed in a vehicle side window.
Figure 2:
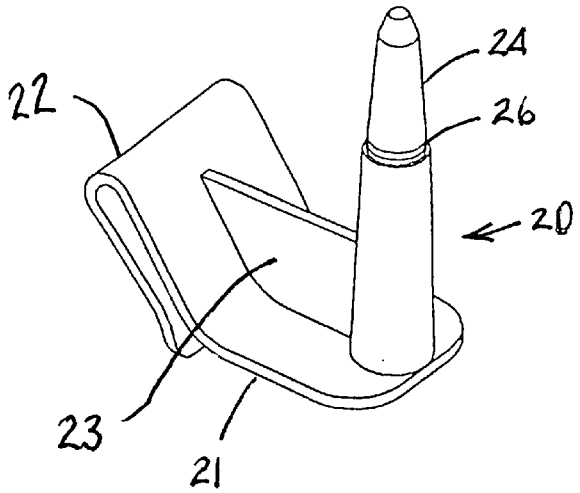
FIG. 2 is a perspective view of the attachment clip portion with the lower portion of the mast adjacent to post.
Figure 3:
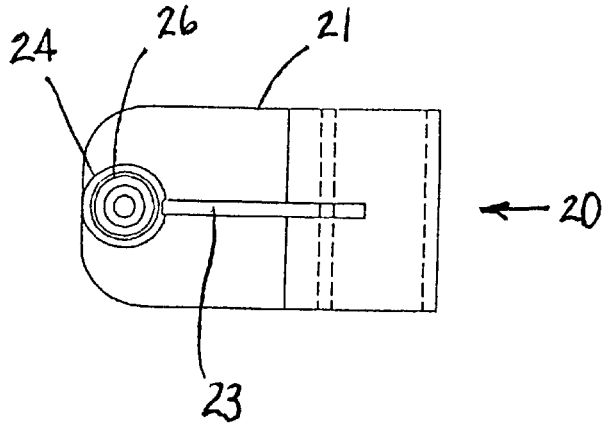
FIG. 3 is a top plan view of the attachment clip portion thereof.
Figure 4:
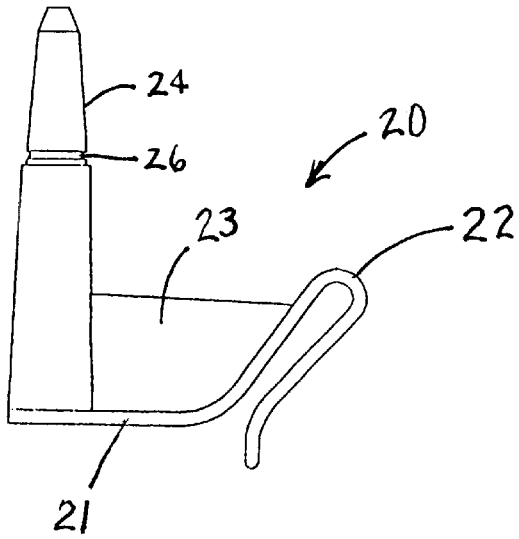
FIG. 4 is a side elevation of the attachment clip portion thereof.
Figure 5:
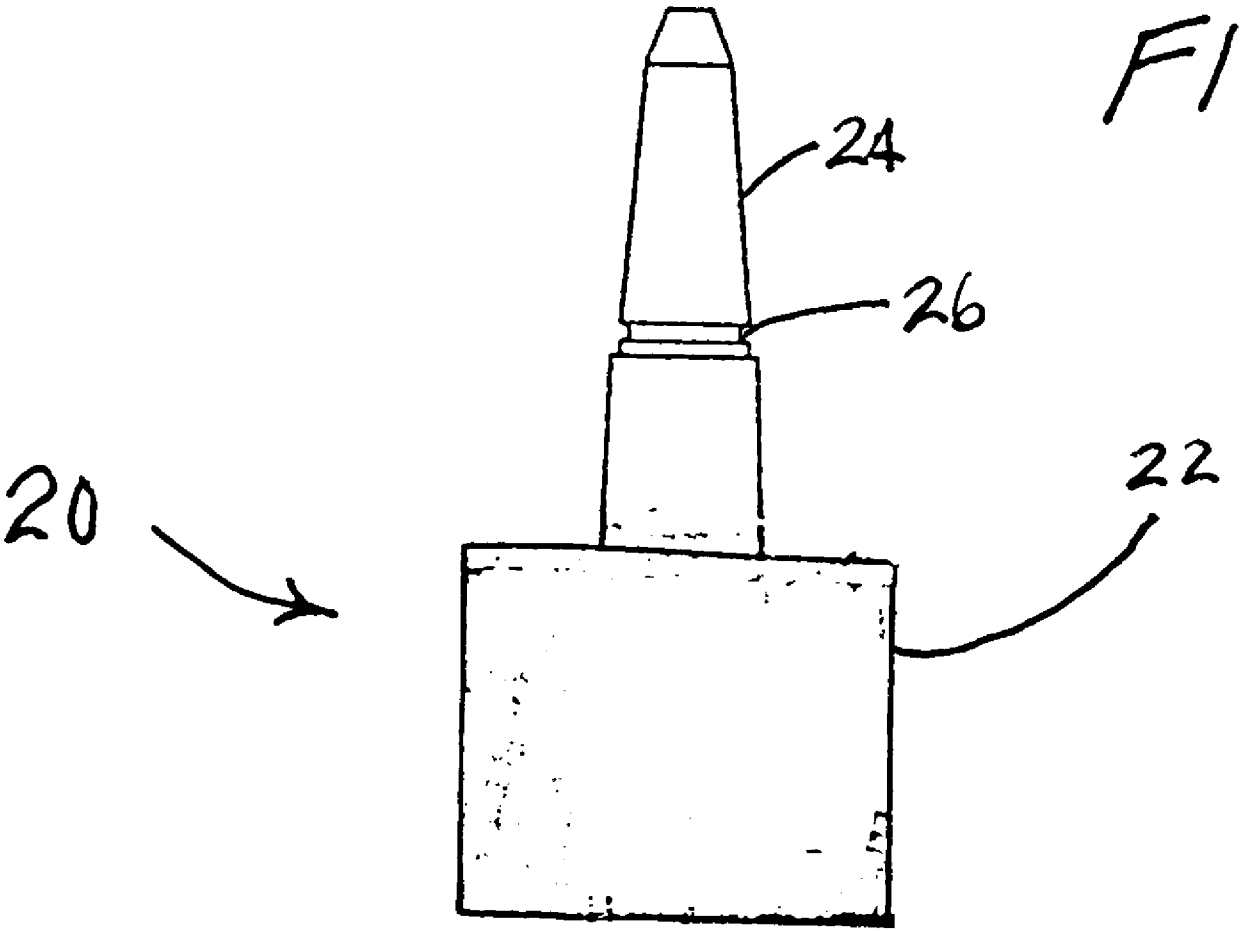
FIG. 5 is a rear view of the attachment clip portion thereof.

As shown in the drawings figures, vehicle locator 1 includes a mast 10 of from about 18–30 inches in axial length, preferably 27 inches in axial length, having display member 12, such as a flag or banner, at distal upper end 10*a* and attachment member 20 with clip 22 at lower proximal end 10*b* thereof.

As shown in FIG. 1, when installed in use, vehicle locator 10 is removably attachable to a vehicle window 11 by clip 22 of attachment member 20, which clip 22 grasps over window 11 to retain mast 10 in a substantially upright position of use, so that display member 12 can be viewed from a distance to locate the vehicle having window 11.

As shown in FIGS. 2, 3, 4 and 5, attachment member 20 includes base 21 having clip 22 extending cantilevered up therefrom, preferably at an oblique angle to separate mast 10 away from the vehicle being located, and brace 23 connecting clip 22 to tenon post 24. Clip 22 is also oblique because most vehicle windows are not vertical, but curve slightly obliquely at the top window 11. Therefore the oblique angle of clip 22 enables mast 10 to extend substantially vertically upward from window 11 for easy viewing of display flag member 12 from a distance, such as in a shopping center or sports stadium parking lot.

As shown in FIG. 1, mast 10 for display flag member 12 attaches over tenon post 24 by spring force of the coils of the compression spring encompassing mast 10.

As also shown in FIG. 1, display flag member 12 is secured to mast 10 by conventional attachment cap member 14, and by a sleeve 16 in display flag member 12, through which sleeve 16 mast 10 is insertable. Instead of sleeve 16, other attachment means for display flag member 12, such as grommets (not shown) can be used.

Display member 12 preferably includes visually perceptible indicia 18 such as a vendor sponsored advertising logo in a contrasting color or shade that differs from a background color or shade of display member 12.

Display member 12 can be made of any durable, wind proof material, such as fabric or a thin plastic substrate, or may be made of a stiff paper, such as #90 water-resistant paper.

Mast 10 is preferably made of a compression spring of a bendable spring-like material, such as thin piano wire or plastic, of about 0.0625 inch in wire diameter (WD), which wire is continuously wound into a spiral of a continuous single helix, approximately ¼ (0.25) inches in outer diameter (OD) with a hollow interior diameter (ID) of about ⅛ (0.125) inch. This gives rigidity to mast 10 when in the erect state. If the diameter of mast 10 would be too wide, such as ½ inch or greater, then mast 10 may lack rigidity.

Mast 10 remains erect if its height does not exceed 27 inches in height. However, mast 10 is very flexible with a modulus of elasticity of $30\times10^6$ psi and a tensile strength of 296,000 psi.

Figure 7:
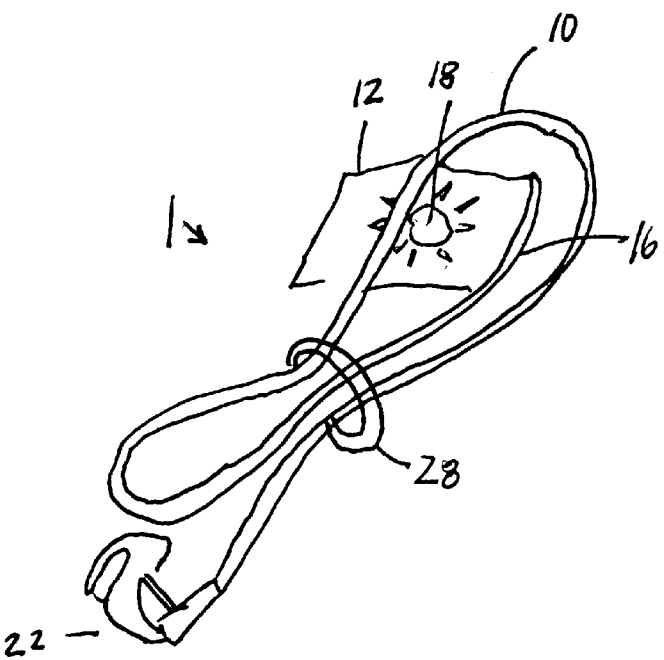
Figure 6:
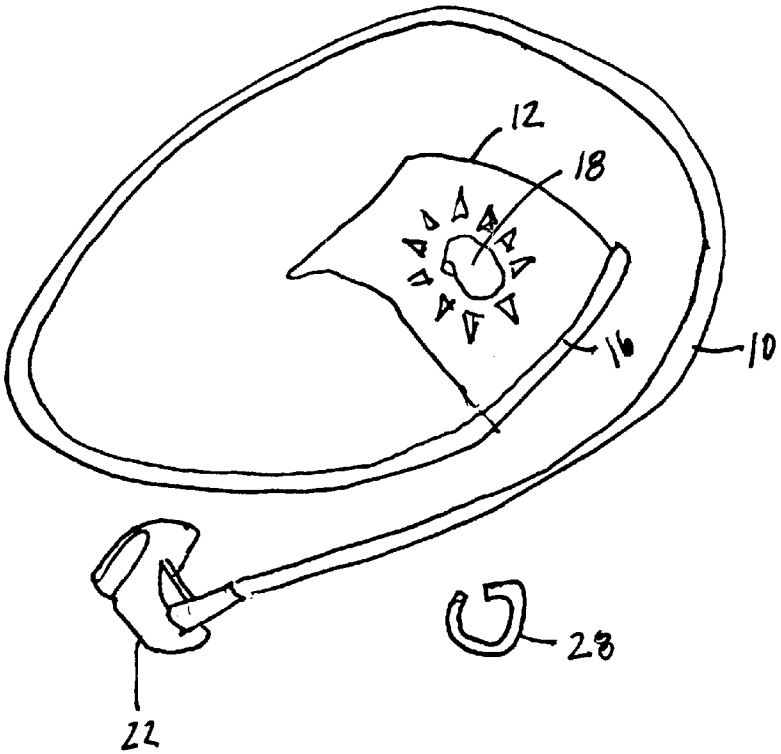
FIG. 6 is a perspective view of the vehicle locator in a coiled position for compact storage; and, FIG. 7 is a perspective view of the vehicle locator in a coiled position, in a loop, closed by a clasp for insertion into a vehicle's glove compartment or other storage area.

Therefore vehicle locator 1 can be folded around itself into a loop, as shown in FIG. 6, and held by clasp 28, as shown in FIG. 7, so it can be reduced in overall length and placed in a vehicle glove compartment for storage.

As further shown in FIG. 1, proximal end 10*b* of mast 10 is preferably wider than the remainder of mast 10, so that the spring-like coils of proximal end 10*b* of mast 10 can firmly grasp over tenon post 24 of clip 22. The outer diameter of proximal end 10*b* is therefore preferably about ⅜ (0.375) inch and the hollow inner diameter of proximal end 10*b* is preferably about 5/16 (0.3125) inch.

Proximal end 10*b* of mast 10 spreads over tenon post 24, thus increasing tension as it goes over tenon post 24. The lowest twist coil portion 10*c* of mast 10 is then grasped in place within circumferential recess channel 26 of tenon post 24 of clip 22.

It is further noted that other modifications may be made to the present invention, without departing from the scope of the invention, as noted in the appended Claims.

I claim:

1. A method of locating a vehicle in a parking lot comprising the steps of:

parking said vehicle in a parking lot containing many additional vehicles;

mounting on an edge of a window of said vehicle a locator device comprising a mast of unitary construction made from a flexible section of a compression spring formed from a metal wire and an inflexible section extending along a proximate end of said mast, said inflexible section comprising a solid member onto end of which said flexible section terminates, said inflexible section having an outer surface with a circumferentially extending scored channel recess to accommodate a last proximal twist of said compression spring, a flag being mounted on a distal end of said mast, said flag having visually perceptible markings thereon to identify said vehicle, and a mounting clip attached to another end of said solid member adapted to be releasably attached to the window edge of said vehicle;

leaving said vehicle in said parking lot with said mast and flag deployed on said window edge;

returning to said vehicle;

removing said mast from said window edge;

rolling up said mast into a diameter of between 6 to 8 inches; and storing the rolled up mast within a glove compartment said vehicle.

2. The method of claim 1 wherein said metal wire is a steel and phosphate metal alloy.

3. The method as in claim 2 wherein said metal alloy comprises the following components indicated by weight of the total composition: about 0.090% copper, about 0.006% phosphorous, about 0.53% manganese, about 0.16% silicon, about 0.86% carbon and about 0.004% sulfur, with the balance being recycled steel.

4. The method of claim 1 wherein said mast is about ¼ inch in outer diameter and about ⅛ inch in inner diameter.

5. The method as in claim 4 wherein said mast is about 27 inches in height to project said flag sufficiently high in a parking lot to extend above any adjacent vehicles.

6. The method of claim 1 wherein said mast is coated with a nickel or tin alloy.

* * * * *